US006029383A

United States Patent [19]

Zappitelli

[11] Patent Number: 6,029,383

[45] Date of Patent: Feb. 29, 2000

[54] SECTIONAL PHOTO DISPLAY CUBE

[76] Inventor: Anthony Joseph Zappitelli, 2910 Oklahoma Rd., Willow Grove, Pa. 19090

[21] Appl. No.: 09/122,017

[22] Filed: Jul. 24, 1998

[51] Int. Cl.[7] ..... G09F 1/12

[52] U.S. Cl. ..... 40/720; 273/157 R; 273/160

[58] Field of Search ..... 273/160, 157 R; 40/720, 605, 729, 735, 780; D21/479

[56] References Cited

U.S. PATENT DOCUMENTS

| | | | |
|---|---|---|---|
| 3,561,146 | 2/1971 | Dembar | 40/720 |
| 3,638,949 | 2/1972 | Thompson | 273/160 X |
| 3,716,936 | 2/1973 | Miller | 40/720 |
| 4,153,254 | 5/1979 | Marc | 273/160 |
| 4,385,467 | 5/1983 | Samuels | 273/157 R X |
| 4,662,638 | 5/1987 | Vachek | 273/160 |
| 4,854,060 | 8/1989 | Corbo et al. | 40/720 |
| 4,854,591 | 8/1989 | Setteducati | 273/157 R |
| 5,090,935 | 2/1992 | Mohson | 273/157 R X |
| 5,393,063 | 2/1995 | Ichimaru | 273/160 |
| 5,405,135 | 4/1995 | Embro | 273/160 |
| 5,823,533 | 10/1998 | Edwards | 273/160 |
| 5,826,873 | 10/1998 | Lavermicocca | 273/160 X |

*Primary Examiner*—Joanne Silbermann
*Attorney, Agent, or Firm*—Woodcock Washburn Kurtz Mackiewicz & Norris LLP

[57] ABSTRACT

A sectional photo display cube having six faces for displaying photos thereon. The cube includes two complementary shaped sections each of which includes a plurality of blocks projecting perpendicularly therefrom. The blocks in one of the sections are shaped to interfit with the blocks in the other of the sections to form a cube when assembled and each of the sections includes at least one surface area forming a fractional portion of each face of the cube.

20 Claims, 2 Drawing Sheets

SECTIONAL PHOTO DISPLAY CUBE

BACKGROUND OF THE INVENTION

1. Field of the Invention

This invention relates in general to photo display cubes, and more particularly to a sectional photo display cube for displaying a plurality of photos.

2. Description of the Prior Art

Photo display cubes are well known in the art. They typically take the form of a plastic cube either hollow or solid having six exterior surfaces for displaying photos. In some of the cubes the photos are permanently attached to the surfaces of the cube and in others provision is made so that the photos may be removed and changed from time to time.

It would be desirable to have a sectional photo display cube which not only has the six exterior faces or surfaces for displaying photos but also has a plurality of interior surfaces which are readily accessible for displaying additional photos. It would farther be desirable that the two sections of the photo display cube interfit with each other in the nature of a simple puzzle so as to hold the two sections together when they are assembled to form the photo display cube.

SUMMARY OF THE INVENTION

It is an object of the present invention to provide a sectional three dimensional polyhedron display device preferably in the form of a cube bounded by six plane faces for displaying indicia of any type including photos thereon. In one form of the invention, the display device comprises two complementary shaped sections, each of the sections including a base surface area located on opposite faces of the device and each of the base surface areas including a plurality of block shaped portions projecting perpendicularly therefrom. The blocked shaped portions in one of the sections is shaped to interfit with the blocked shaped portions in the other of the sections to form a polyhedron when assembled and each of the sections includes at least one surface area forming a fractional portion of each face of the polyhedron.

In one form of the invention the sectional three dimensional display device is in the form of a cuboidal display device having six faces for displaying indicia thereon. The device comprises two complementary shaped sections, each of which includes a base surface area located on opposite faces of the device and each of the base surface areas forming a side of a plurality of rectangular parallelepipeds projecting therefrom. The parallelepipeds in one of the sections is shaped to interfit with the parallelepipeds in the other of the sections to form a cuboidal when assembled and each of the sections includes at least one surface area forming a fractional portion of each face of the cuboidal display device.

In the preferred form of the invention the three dimensional display device is a display photo cube having six faces for displaying photos thereon. The cube comprises complementary shaped sections, each of the sections including a base surface area located on opposite faces of the cube. Each of the base surface areas forms a side of a plurality of blocks projecting perpendicularly therefrom, the blocks in one of the sections being shaped to interfit with the blocks in the other of the sections to form a cube when assembled. Each of the sections includes at least one surface area forming a fractional portion of each face of the display cube and each face of the display cube includes unitary indicia in the form of a photo. Further in accordance with the invention the interior surfaces of the sections are provided with individual indicia or photos.

BRIEF DESCRIPTION OF THE DRAWINGS

For a more detailed disclosure of the invention and for further objects and advantages thereof, reference is to be had to the following description taken in conjunction with the accompanying drawings, in which.

DESCRIPTION OF THE PREFERRED EMBODIMENT

Glossary

Before describing the preferred embodiment it is believed that it will be helpful to define the technical terms used herein. These technical terms are used in their ordinary dictionary meaning as follows:

Cube—A solid bounded by six equal squares and having all its angles right angles.

Cuboid—Shaped like a cube.

Cuboidal—A rectangular parallelepiped.

Parallelepiped—A prism with six faces each of which is a parallelogram.

Polyhedron—A solid bounded by plane faces especially by more than four.

Hexahedron—A polyhedron bounded by six plane faces.

Indicia—Discriminating marks including signs, letters, numerals, drawings and photos.

Figure 1:
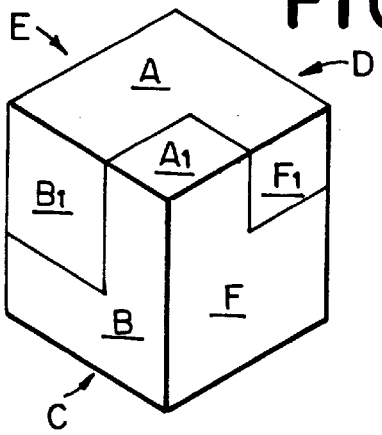
FIG. 1 is a perspective view of the present invention showing three faces of the sectional display cube.
Figure 2:
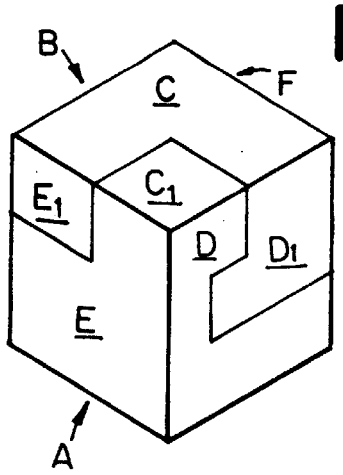
FIG. 2 is a perspective view of the present invention showing the other three faces of the sectional display cube.
Figure 3:
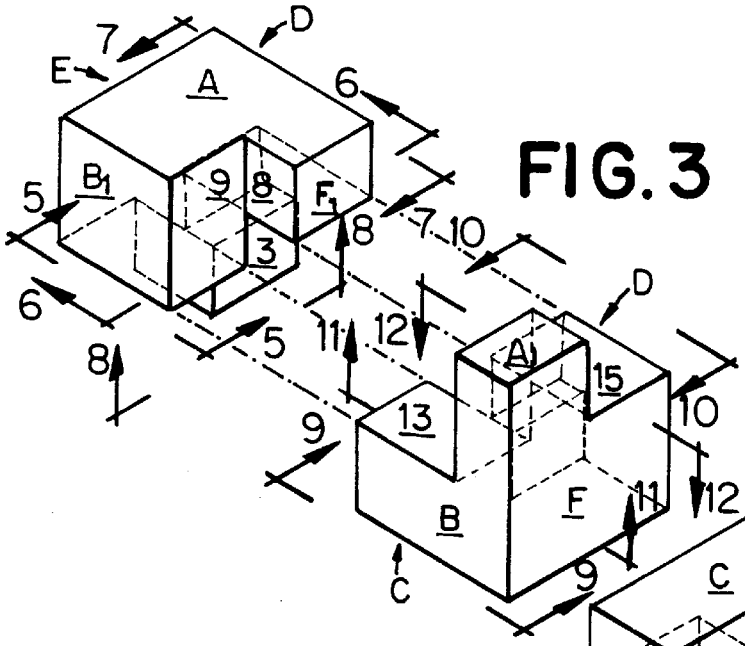
FIG. 3 is an exploded perspective view of the assembled display cube shown in FIG. 1.
Figure 4:
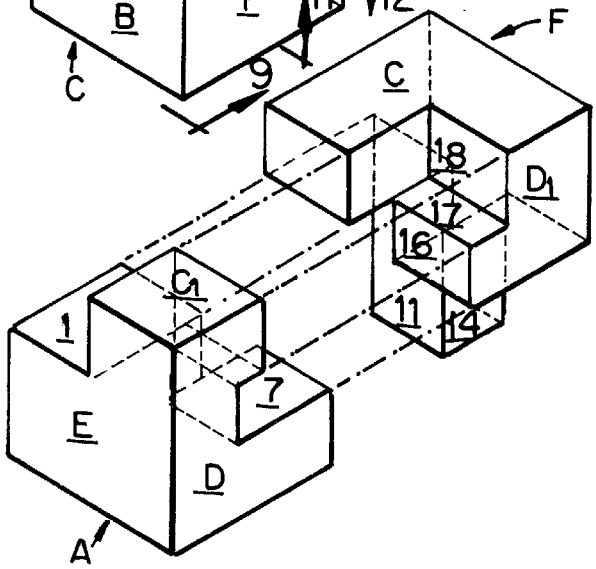
FIG. 4 is an exploded perspective view of the sectional display cube shown in FIG. 2.
Figure 5:
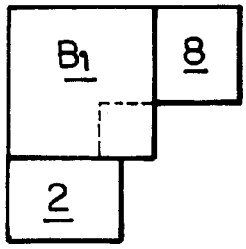
FIG. 5 is an elevational view taken along the lines 5—5 in FIG. 3.

Referring to FIGS. 1 and 2 of the drawing it will be seen that there is illustrated a sectional three dimensional hexahedron display device 10 bounded by six plane faces for displaying indicia thereon. Three of the six faces bearing the letters A, B and F are shown in FIG. 1 and the other three faces bearing the letters C, E and D are shown in FIG. 2. As may be seen in FIGS. 1–4 the cube 10 comprises two complementary shaped sections, each of the sections including a base surface area located on opposite faces of the cube 10. The base surface area in one of the sections bears the indicia or letter E and the base surface area in the other section bears the indicia or letter F. Each of the base surface areas E and F form a side of a plurality of blocks projecting perpendicularly therefrom. For purposes of simplicity in explaining the invention, the section with the base surface area E will be referred to as the E section and the section with the base surface area F will be referred to as the F section. As shown in FIGS. 3 and 4 the two sections of the cube 10 are assembled together along the broken lines illustrated in those figures. Each of the sections has 9 interior surfaces and in section E the interior surfaces are provided with the number 1 through 9. This is best seen in FIGS. 5–8. In section F the interior surfaces are provided with the numbers 11–19 and is best shown in FIGS. 9–12.

When the two sections of the cube are assembled, the inner surfaces of the sections will engage each other as follows:

| Section E | Section F |
|---|---|
| 1 | 13 |
| 2 | 19 |
| 3 | 18 |
| 4 | 17 |
| 5 | 12 |
| 6 | 16 |
| 7 | 15 |
| 8 | 14 |
| 9 | 11 |

Figure 6:
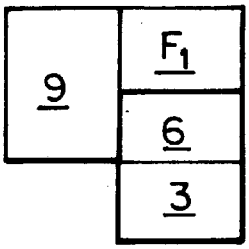
FIG. 6 is an elevational view taken along the lines 6—6 in FIG. 3.
Figure 7:
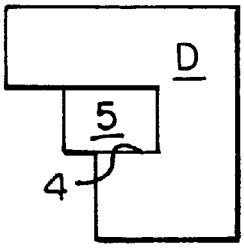
FIG. 7 is an elevational view taken along the lines 7—7 in FIG. 3.
Figure 8:
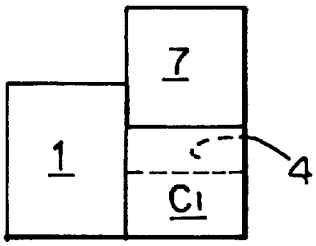
FIG. 8 is a bottom plane view taken along the lines 8—8 in FIG. 3.
Figure 9:
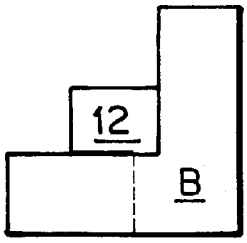
FIG. 9 is an elevational view taken along the lines 9—9 in FIG. 3.
Figure 10:
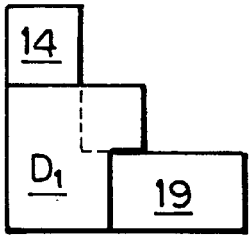
FIG. 10 is an elevational view taken along the lines 10—10 in FIG. 3.
Figure 11:
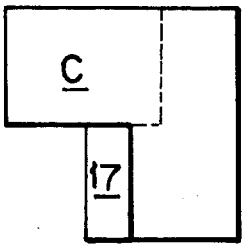
FIG. 11 is a bottom plan view taken along the lines 11—11 in FIG. 3.
Figure 12:
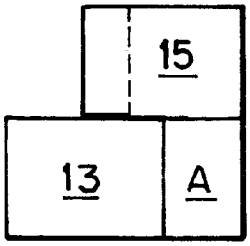
FIG. 12 is a top plan view taken along the lines 12—12 in FIG. 3.

Referring to the drawings it will be seen that four blocks project perpendicularly from the surface are E. The end surface areas of the blocks bear the indicia $F_1$, 9, 6 and 3. This is best seen in FIG. 3 and 6. The sections of the cube having the base section area F also has four blocks projecting perpendicularly therefrom. The end surface area of these blocks bear the indicia $E_1$, 18,. 16 and 11. This is best seen in FIG. 4. It will be noted that the blocks having the end surfaces bearing the indicia $E_1$ and $F_1$ have a height corresponding to the edge dimension of the cube 10.

When the two sections of the cube 10 are separated as shown in FIGS. 3 and 4 it will be seen that the blocks in the E section of the cube are shaped to interfit with the blocks in the F section of the cube to form the cube 10 when assembled. The end surfaces 9, 6 and 3 of the blocks in section E engage the end surfaces 11, 16 and 18 of the blocks in section F and the mating blocks in each section have a combined height equal to the edge dimension of the cube 10. It will also be seen that when the two sections are assembled, each of the sections will include at least one surface area forming a fractional portion of each face of the cube. Referring to FIG. 1, it will be seen that section E includes a surface area $F_1$ which forms a fractional portion of face F of the cube. It will also be seen that section E includes a surface area $B_1$ which forms a fractional portion of base B of the cube. It will also be seen in FIG. 1 that section F includes the surface area $A_1$ which forms a fractional portion of face A of the cube. Referring to FIG. 2 it will be seen that section F includes a surface area $D_1$ which forms a fractional portion of face D of the cube. It will also be seen that Section F includes a surface area $E_1$ which forms a fractional portion of face E of the cube. Also shown in FIG. 2 it will be seen that Section E of the cube includes a surface area $C_1$ which forms a fractional portion of face C of the cube.

From the drawings it will be seen from the photo display cube 10 is a sectional cuboidal display device having six faces for displaying indicia thereon. Each of the two complementary shaped sections includes a base area located on opposite faces of the device and each base surface area forms a side of a plurality of rectangular parallelepipeds projecting therefrom. The parallelepipeds in one of the sections is shaped to interfit with the parallelepipeds in the other of the sections to form a cuboidal when assembled and each of the sections includes at least one surface area forming a fractional portion of each face of the cuboidal display device. In the preferred form of the invention each of the six faces of the cuboidal display device will bear a unitary design or indicia preferably in the form of a photograph. Thus each of the faces or sides A, B, C, D, E and F will carry a unitary photo and the fractional $A_1$, $B_1$, $C_1$, $D_1$, $E_1$ and $F_1$ will carry a corresponding fractional portion of those photos. The interior surfaces of the cube 1–9 and 11–19 will normally carry individual photos. Preferably the size of the surface area will determine the size of the photos. Thus each interior surface area of the cube will display a complete photo as do the six exterior faces of the cube.

It is to be understood that the sections of the display cube 10 may be solid or hollow. In one form of the invention the sections were constructed by foam filled laminated poster board to provide rigidity while minimizing the overall weight. In one embodiment the dimensions of the cube were 4⅜" by 4⅜". In another embodiment the dimensions were 6"×6".

It is also to be understood that the photo display device may take shapes other than a cube such as other shapes of polyhedrons or hexahedrons within the scope of the appended claims.

What is claimed is:

1. A sectional display cube having six faces for displaying indicia thereon, said cube comprising two complementary shaped sections, each of said sections including a base surface area located on opposite faces of said cube, each of said base surface areas forming a side of a plurality of blocks projecting perpendicularly therefrom, said blocks in one of said sections being shaped to interfit with the blocks in the other of said sections to form a cube when assembled, and each of said sections including at least one surface area forming a fractional portion of each face of said cube.

2. A sectional display cube according to claim 1 wherein each of said faces of said cube includes unitary indicia.

3. A sectional display cube according to claim 2 wherein at least one surface of said sections located within the interior of said cube is provided with individual indicia.

4. A sectional display cube according to claim 3 wherein all of the interior surfaces of said sections are provided with individual indicia.

5. A sectional display cube according to claim 2 wherein said unitary indicia comprises a photo.

6. A sectional photo display cube according to claim 5 wherein at least one surface of said sections located within the interior of said cube is provided with an individual photo.

7. A sectional photo display cube according to claim 6 wherein all of the interior surfaces of said sections are provided with individual photos.

8. A sectional display cube according to claim 1 wherein each base surface area is bounded by at least four edges of the cube.

9. A sectional display cube according to claim 8 wherein each base surface is bounded by at least six edges of the cube.

10. A sectional display cube according to claim 1 wherein at least four blocks project from each surface area.

11. A sectional display cube according to claim 1 wherein the mating blocks in each section have a combined height equal to the edge dimension of the cube.

12. A sectional display cube according to claim 1 wherein at least one block in each section has a height corresponding to the edge dimension of the cube.

13. A sectional cuboidal display device having six faces for displaying indicia thereon, said device comprising two complementary shaped sections, each of said sections including a base surface area located on opposite faces of said device, each of said base surface areas forming a side of a plurality of rectangular parallelepipeds projecting therefrom, said parallelepipeds in one of said sections being shaped to interfit with the parallelepipeds in the other of said sections to form a cuboidal when assembled, and each of said sections includes at least one surface area forming a fractional portion of each face of said cuboidal display device.

14. A sectional three dimensional polyhedron display device bounded by more than four plain faces for displaying indicia thereon, said device comprising two complementary shaped sections, each of said sections including a base surface area located on opposite faces of said devices each of said base surface areas including a plurality of block shaped portions projecting perpendicularly therefrom, said block shaped portions in one of said sections being shaped to interfit with the block shaped portions in the other of said sections to hold said two sections together to form a polyhedron when assembled, and each of said blocked shaped portions on each of said two sections including interior surfaces for displaying indicia thereon and exposed only when said two sections of said polyhedron are disassembled.

15. A sectional three dimensional display device according to claim 14 wherein said polyhedron is a hexahedron bounded by six plan faces, and each of said sections including at least one surface area forming a fractional portion of each face of said hexahedron.

16. A three dimensional display device according to claim 15 wherein each face of said hexahedron includes unitary indicia.

17. A three dimensional display device according to claim 16 wherein at least one surface of said sections located within the interior of said hexahedron is provided with individual indicia.

18. A three dimensional display device according to claim 17 wherein all of the interior surfaces of said sections are provided with individual indicia.

19. A three dimensional display device according to claim 16 wherein said unitary indicia comprises a photo.

20. A three dimensional display device according to claim 19 wherein at least one surface of said sections located within the interior of said hexahedron is provided with an individual photo.

* * * * *

UNITED STATES PATENT AND TRADEMARK OFFICE

CERTIFICATE OF CORRECTION

PATENT NO. : 6,029,383
APPLICATION NO. : 09/122017
DATED : February 29, 2000
INVENTOR(S) : Anthony Joseph Zappitelli It is certified that error appears in the above-identified patent and that said Letters Patent is hereby corrected as shown below:

Column 1,
Line 20, please delete "farther" and insert therefore --further--.

Signed and Sealed this

Seventeenth Day of July, 2007

JON W. DUDAS
*Director of the United States Patent and Trademark Office*